US005918840A

United States Patent [19]

Christensen

[11] Patent Number: 5,918,840

[45] **Date of Patent: *Jul. 6, 1999**

[54] INTEGRATED MOUSE PAD AND WRIST AND ARM SUPPORT

[76] Inventor: Leslie Palmatier Christensen, 6864 B Brindle Heath Way, Alexandria, Va. 22315

[ * ] Notice: This patent is subject to a terminal disclaimer.

[21] Appl. No.: 08/971,676

[22] Filed: Nov. 17, 1997

Related U.S. Application Data

[63] Continuation-in-part of application No. 08/521,657, Aug. 31, 1995, Pat. No. 5,727,759.

[51] Int. Cl.[6] ..... B43L 5/00

[52] U.S. Cl. ..... 248/118; 248/118.3; 248/289.11; 248/918; 297/411.23; 297/411.36

[58] Field of Search ..... 248/118, 118.1, 248/118.3, 118.5, 918, 289.11, 298.1; 297/411.23, 411.27, 411.35, 411.36, 411.37, 188.2, 188.21

[56] References Cited

U.S. PATENT DOCUMENTS

| | | | |
|---|---|---|---|
| 1,007,590 | 10/1911 | Miller | 248/289.11 |
| 2,659,423 | 11/1953 | Haley | 297/411.36 X |
| 3,140,119 | 7/1964 | Offner | 297/411.35 |
| 4,576,351 | 3/1986 | Brink | 248/118 |
| 4,822,103 | 4/1989 | Stenvall | 297/411.35 |
| 4,961,610 | 10/1990 | Reeder et al. | 297/411.35 |
| 5,338,133 | 8/1994 | Tornero | 297/411.37 |
| 5,439,268 | 8/1995 | Dozsa-Farkas | 297/411.35 |
| 5,513,898 | 5/1996 | Kanai et al. | 297/411.27 |
| 5,641,203 | 6/1997 | Van De Riet et al. | 297/411.36 X |
| 5,727,759 | 3/1998 | Christensen | 248/118 |

*Primary Examiner*—Derek J. Berger

[57] ABSTRACT

An integrated mouse pad and wrist and arm support which can be attached to a desk chair and which provides support for both the wrist and arm of a computer operator. The device provides a support arm with a mouse pad at one end and enables the user's wrist and arm to rest at approximately the same level as the mouse pad. Use of the device reduces stress to the wrist and arm during use of the mouse. The device is attached to the underside of the seat of the chair by an attachment member, the height of which can be adjusted as desired by the operator. The angular position of the support arm with respect to the operator can be adjusted to a selected ergonomic position. In one embodiment, the length of the support arm can be adjusted to a selected ergonomic position.

1 Claim, 4 Drawing Sheets

INTEGRATED MOUSE PAD AND WRIST AND ARM SUPPORT

This application is a continuation-in-part of application Ser. No. 08/521,657, filed Aug. 31, 1995, now U.S. Pat. No. 5,727,759.

BACKGROUND OF THE INVENTION

1. Field of the Invention

This invention relates to a mouse pad having a support member associated with the mouse pad and which extends from the mouse pad to provide support for the user's wrist and arm. The integrated mouse pad and support member is configured so as to be attachable to a chair in which the user sits when using the mouse pad while operating a computer.

2. Description of the Prior Art

There is growing concern about the need for comfortable positioning of the wrist and arm of a user of a keyboard for inputting text and data to a computer. Operators of the computer also use a mouse to input commands to the computer. Manipulation of the mouse requires the use of both wrist and arm movements. The mouse is placed on a mouse pad which is positioned near the keyboard and the user must often perform many mouse operations during a given day of using the computer, each operation requiring that the mouse be grasped, moved, and clicked. These operations currently must be performed without adequate support for the wrist and arm of the user, resulting in muscle and tendon strain which can lead to discomfort or even permanent injury.

SUMMARY OF THE INVENTION

In order to provide support for the wrist and arm of the user of the mouse, a mouse pad having an integrated support member is provided. The support member and the mouse pad are constructed using either a one-piece or a two-piece configuration with the support member extending from the mouse pad toward the user permitting the user to rest the wrist and forearm on the support member. The mouse pad with integrated support member is attachable to the bottom of a chair using an attaching member, the height of which can be adjusted. The angular position of the mouse pad and integrated support member relative to the user can be adjusted to a selected ergonomic position and locked in place by means of a positioning platform and associated positioning pin, positioning holes, and a spring-loaded plunger.

DETAILED DESCRIPTION OF THE INVENTION

The detailed description will hereunder be given of the preferred embodiment of the integrated mouse pad and wrist and arm support with positioning and attaching assemblies with reference to the accompanying drawings.

Figure 1:
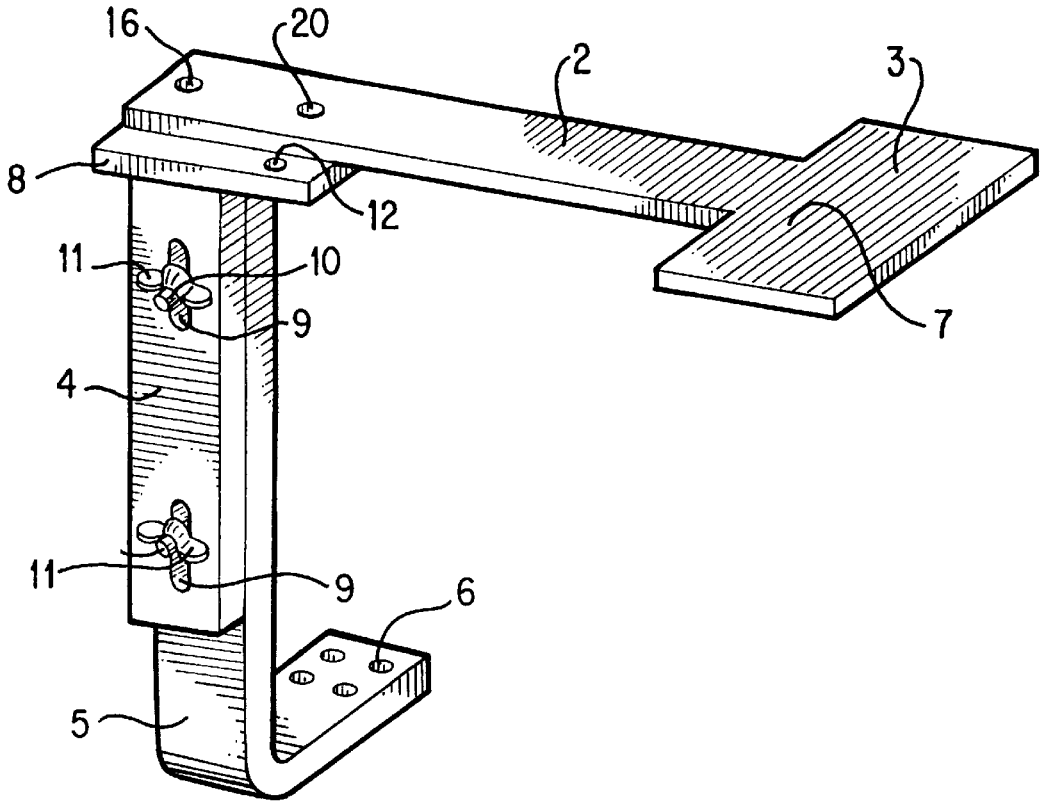
FIG. 1 is a perspective view showing the integrated mouse pad and one-piece wrist and arm support member, along with the positioning platform and the attaching member.

FIG. 1 shows a mouse pad portion 3 and a support member portion 2 which are formed as an integral, one-piece, metal platform, the top surface of which forms a common plane which is coated with a vinyl material 7 known to be suitable for forming the surface of a mouse pad. The support member 2 provides support for the wrist and arm of the user of a mouse which is typically placed on the mouse pad portion during operation of a computer. A means for attaching the integrated mouse pad and wrist and arm support to a chair is provided in the form of a two-piece metal attaching means comprising a first attaching member 4 and a second attaching member 5. The first attaching member 4 is welded, at its top end, to a positioning platform 8 which mates with the support member portion at the end which is opposite to the end which forms the mouse pad (The mating of the support member portion with the positioning platform will be described below). The first attaching member 4 extends downward from the position platform and is attached to a second attaching member 5, and in a first embodiment the first and second attaching members are attached by means of two adjustable connections. These adjustable connections are provided in the form of four vertical slots 9, two of which are milled through each of the first and second attaching members, and the vertical position of the bolt secured in the slot by wing nuts 11. By means of the vertical slots, the bolts, and the wing nuts the height of the attaching member is made adjustable. The second attaching member 5 is affixed to the underside of a chair seat using fasteners such as screws or bolts.

Figure 2:
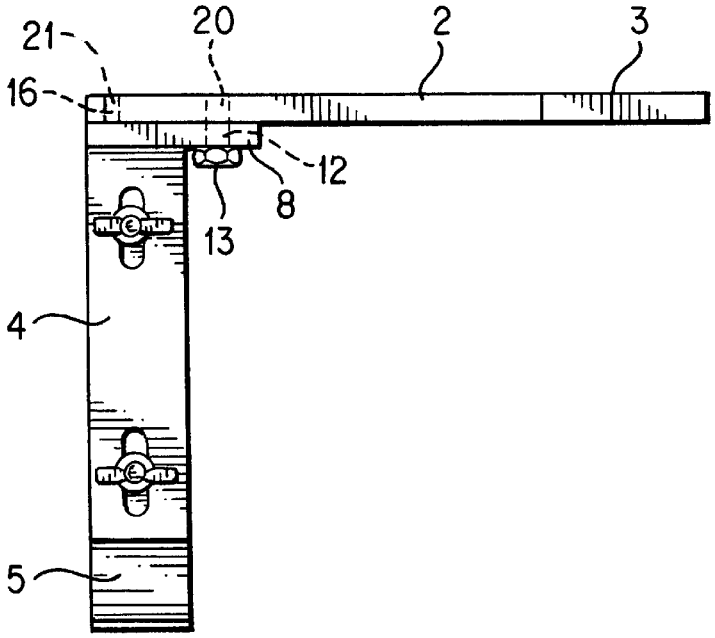
FIG. 2 is a side view showing the relationship between the support member portion, the positing platform and the attaching member.
Figure 3:
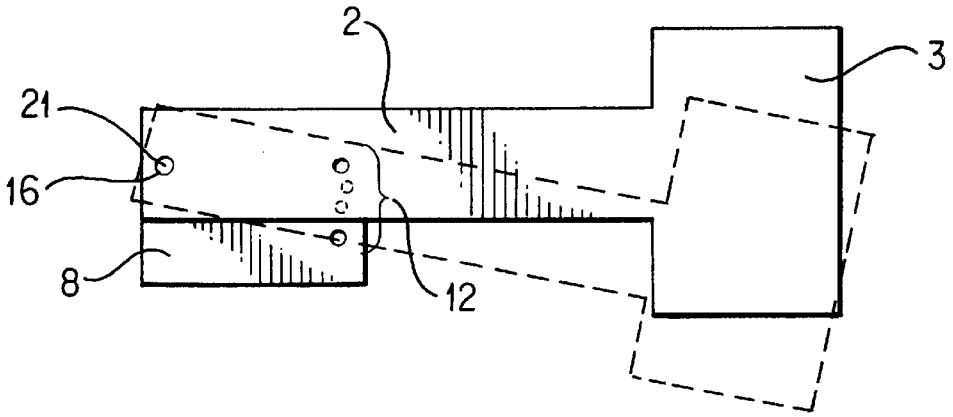
FIG. 3 is a top view showing adjustable positioning of the mouse pad and integrated wrist and arm support.

As seen in FIGS. 1, 2, and 3, the angular position of the support member relative to the user is made adjustable to a selected ergonomic position by means of a positioning platform 8, swivel pin 21, positioning hole 16, three position adjustment holes 12, locking hole 20, and spring-loaded plunger 13 (see FIGS. 2 & 3). The positioning platform 8 is a flat metal piece with a swivel pin 21 extending upward from the top surface and used to mate with a swivel pin positioning hole 16 in the support member portion 2. A plurality of position adjustment holes 12 are drilled through the positioning platform 8. The first attaching member 4 is welded to the bottom of the positioning platform 8. Locking hole 20 is drilled through the support member 2.

The support member 2 is positioned for use by mating the support member 2 with the positioning platform 8 such that the swivel pin 21 of the positioning platform 8 fits into the swivel pin positioning hole 16 of the support member portion 2. The support member portion 2 is then swiveled about the swivel pin 21 until its locking hole 20 lines up with one of the plurality of position adjustment holes 12 in the positioning platform 8. A spring-loaded plunger 13 is used as a locking means and is attached to the underside of the positioning platform 8 so that it can be inserted into a selected position adjustment hole 12 from the bottom side of the positioning platform 8 in order to secure the desired angle of the support member 2.

Figure 4:
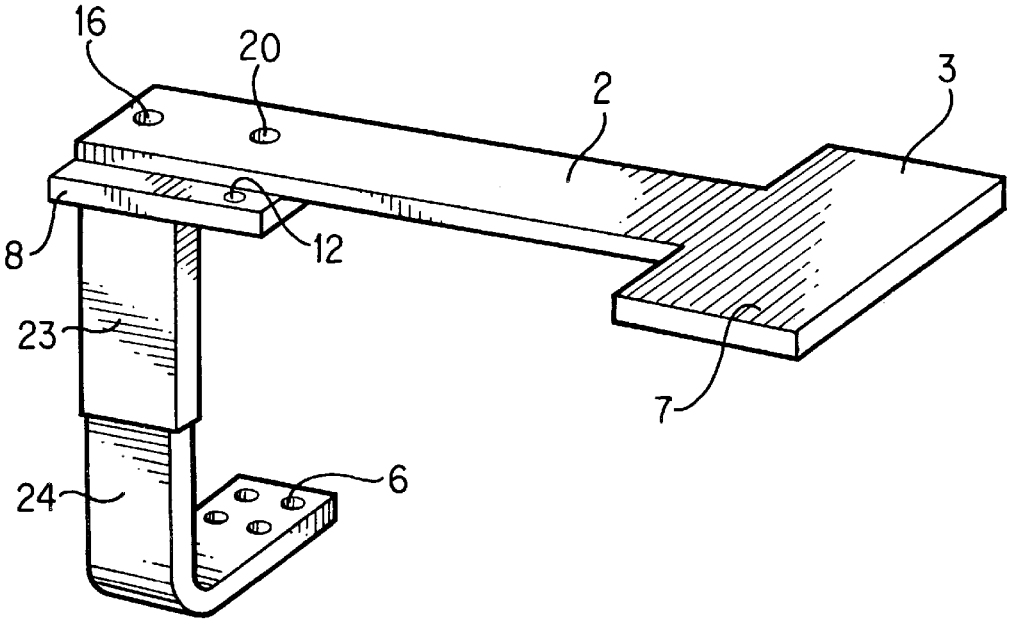
FIG. 4 is a perspective view showing the integrated mouse pad and one-piece wrist and arm support member, along with the positioning platform and a telescoping attaching member.

FIG. 4 presents, as a second embodiment, an alternative means for constructing the attaching means. A first member

23 and a second member 24 are formed as a telescoping unit, with the second attaching member 24 being fitted inside the first attaching member 23 so as to enable height adjustment. Such a construction is well known in the art and is readily available for use as the attaching means.

Figure 5:
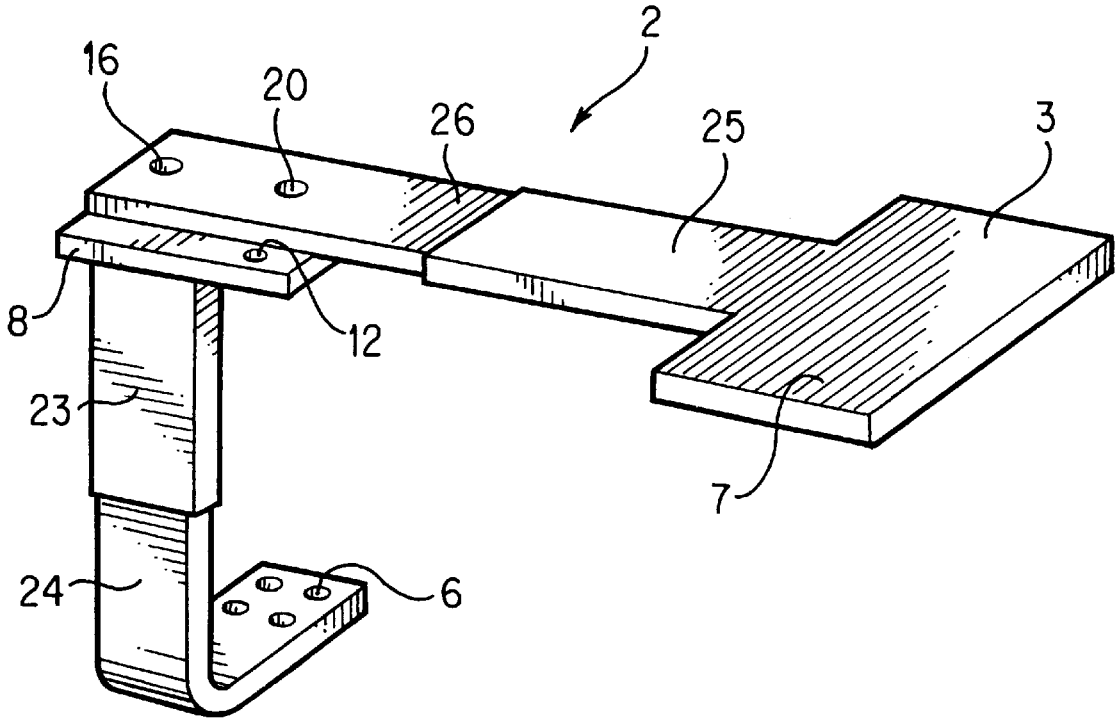
FIG. 5 is a perspective view showing the integrated mouse pad and two-piece wrist and arm support member, along with the positioning platform and a telescoping attaching member.

FIG. 5 presents, as a third embodiment, and alternative means for constructing the support member. In this embodiment a first member 25 and a second member 26 are formed as a two-piece telescoping unit with the second member 26 being fitted inside the first member 25 so as to enable length adjustment. Such a construction is well known in the art and is readily available for use as the support member.

Figure 6:
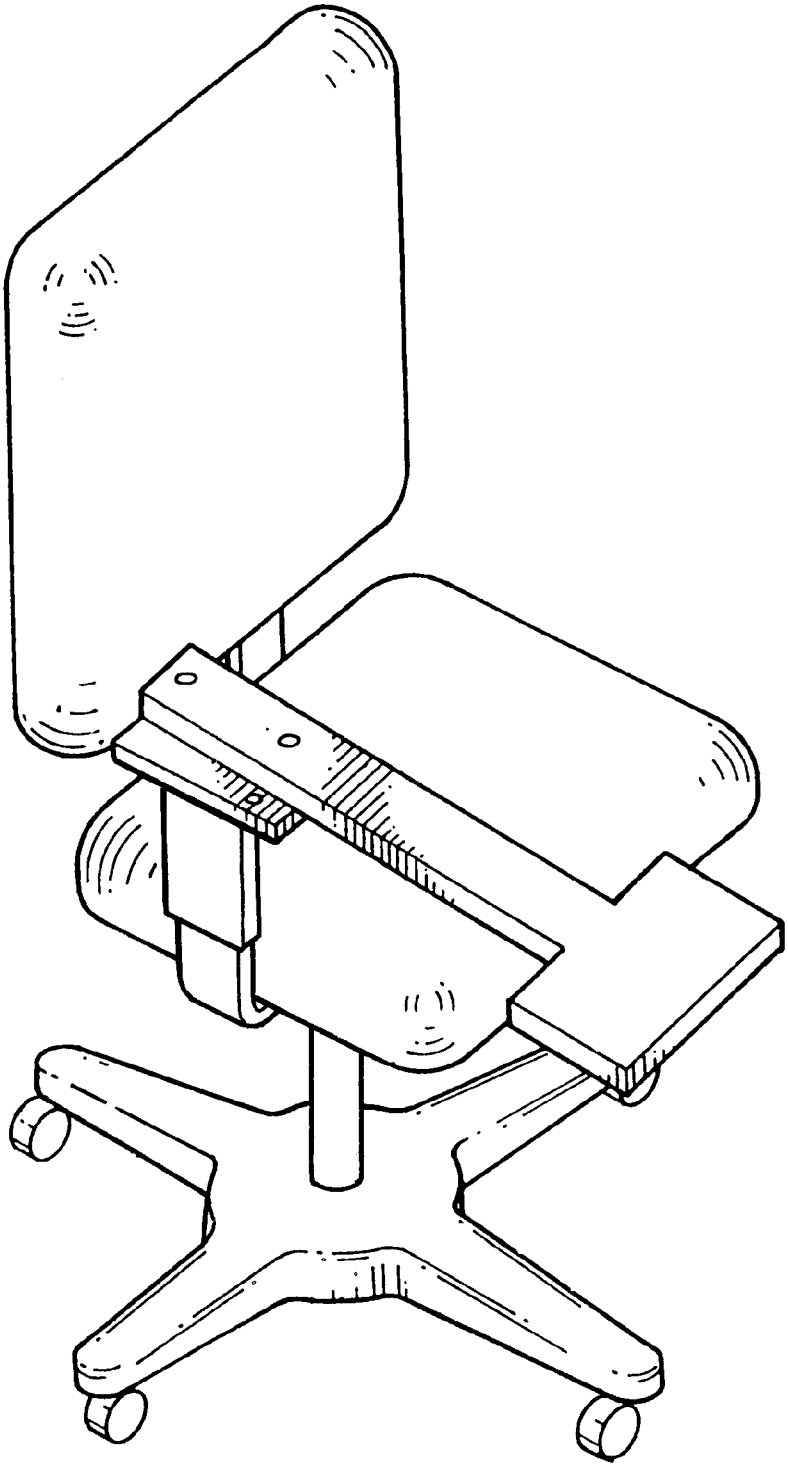
FIG. 6 is a perspective view showing the integrated mouse pad and wrist and arm support attached to an armless chair.

FIG. 6 shows the integrated mouse pad and wrist and arm support assembly attached to a chair and ready for use.

What is claimed is:

1. An integrated mouse pad and wrist and arm support with positioning and attaching assemblies, comprising;

a support arm formed as a flat, one-piece, elongated member having first and second ends, the shape of said elongated member being that of an elongated rectangle except at the first end, said first end being shaped to be larger in size than said second end, said first end being configured in the shape of a computer mouse pad and comprising a mouse pad portion of said flat, one-piece, elongated member, the remainder of said flat, one-piece elongated member comprising a wrist and arm support portion;

a positioning assembly comprising a positioning platform, a swivel pin extending upward from said positioning platform, a swivel pin positioning hole located in said wrist and arm support portion, a plurality of position adjustment holes located in said positioning platform, a locking hole located in said wrist and arm support portion, and a spring-loaded plunger, said swivel pin configured to mate with said swivel pin positioning hole, said spring-loaded plunger configured to mate with one of said position adjustment holes and said locking hole, said positioning assembly thus permitting an angular positioning adjustment of said wrist and arm support portion;

and an attaching assembly for attaching said integrated mouse pad and wrist and arm support and positioning assembly to the bottom of a chair seat, said attaching assembly comprising first and second vertical attaching members said first attaching member having an upper end permanently attached to said positioning platform, said second vertical attaching member having a curved lower portion enabling attachment to the bottom of a chair seat, said first and second attaching members being slidably attached to each other.

* * * * *